United States Patent [19]

Sato

[11] 4,119,076

[45] Oct. 10, 1978

[54] IGNITION SYSTEM FOR AN INTERNAL COMBUSTION ENGINE

[75] Inventor: Hiroo Sato, Susono, Japan

[73] Assignee: Kokusan Denki Co., Ltd., Numazu, Japan

[21] Appl. No.: 714,803

[22] Filed: Aug. 16, 1976

[30] Foreign Application Priority Data

| | | | |
|---|---|---|---|
| Aug. 19, 1975 | [JP] | Japan | 50-100297 |
| Aug. 19, 1975 | [JP] | Japan | 50-100298 |
| Sep. 5, 1975 | [JP] | Japan | 50-107872 |

[51] Int. Cl.[2] ..... F02P 1/00

[52] U.S. Cl. ..... 123/148 E; 315/209 T

[58] Field of Search ..... 315/209 T, 209 CD, 209 R; 123/148 E, 148 CC; 310/70 A, 70 R

[56] References Cited

U.S. PATENT DOCUMENTS

| | | | |
|---|---|---|---|
| 3,260,251 | 7/1966 | Lange | 123/148 E |
| 3,280,810 | 10/1966 | Worrell | 123/148 E |
| 3,421,488 | 1/1969 | Tarter | 123/148 E |
| 3,424,944 | 1/1969 | Nilssen | 123/148 E |
| 3,484,677 | 12/1969 | Pitco | 123/148 E |
| 3,851,636 | 12/1974 | Just | 123/148 CC |

*Primary Examiner*—Ronald B. Cox

*Attorney, Agent, or Firm*—Woodling, Krost, Granger & Rust

[57] ABSTRACT

An ignition system for an internal combustion engine having an AC generator compriss an ignition coil energized by an output from the generator. At an angle in advance of ignition timing, a first thyristor connected across the generator output terminals is turned on to permit a short-circuit current therethrough. A capacitor is charged by an output from the generator, and is discharged through a second thyristor which is triggeed at the ignition angle. The discharge current is reversely applied to the first thyristor and the first thyristor is turned off. Interruption of the short-circuit current through the first thyristor leads to a large current through the primary of the ignition coil, causing a high voltage in the secondary with resultant spark in the ignition plug.

4 Claims, 17 Drawing Figures

IGNITION SYSTEM FOR AN INTERNAL COMBUSTION ENGINE

BACKGROUND OF THE INVENTION

The present invention relates to an ignition system for an internal combustion engine.

A conventional ignition system as is disclosed in U.S. Pat. No. 3,424,944 comprises a first thyristor connected in series with the primary winding of an ignition coil, a second thyristor having the cathode thereof connected to the cathode of the first thyristor and a capacitor coupling the anodes of the first and second thyristors. A DC power source supplies a DC current at a constant voltage. The first thyristor is turned on in advance of the ignition timing of the engine. The current through the primary winding is established. Meantime, the capacitor is charged through a path including the first thyristor. At the ignition timing, the second thyristor is turned on and the capacitor is discharged through the second thyristor to apply a reverse voltage across the anode and cathode of the first thyristor, so that the first thyristor is turned off. The turn-off of the first thyristor leads to sudden decrease of the primary current, which in turn causes generation of a high voltage in the secondary winding.

It is first noted that this conventional ignition system is intended to be used in an engine provided with a DC power source of constant voltage such as batteries and does not operate in an engine which is provided with an AC generator instead of batteries.

Secondly, as the output voltage from the DC power source is constant the voltage applied to the primary winding is constant regardless of the engine speed. Inductance and resistance of the primary winding and of any element in series circuit with the primary winding as well as the voltage applied to the primary winding determine the length of time required for the primary current to be established, or in other words, to reach a value sufficient to cause, when suddenly reduced to nil, a high voltage in the secondary winding. Since the inductance, the resistance and the voltage applied are all constant in this conventional system, the time required for establishing the primary current is constant regardless of the engine speed. On the other hand, the time required for one cycle of operation becomes shorter as the engine speed increases. As a result, at engine speeds which are too high for the primary current to be fully established, a voltage generated in the secondary winding is insufficient. This means that the engine speed may be limited by the factors of the resistance and the inductance as well as the voltage.

Another factor that may limit the engine speed is the time required for charging the capacitor. The capacitor has to be charged to a voltage which is sufficient to turn off the first thyristor when the capacitor is subsequently discharged through the second thyristor to apply a reverse voltage across the anode and cathode of the first thyristor. In this conventional system, the capacitor is charged by an oscillator and this charging begins when the first thyristor conducts. Output voltage of the oscillator is constant and therefore the time required for completing the charging is constant regardless of the engine speed. As the engine speed becomes so high that time allotted for the full charging of the capacitor is insufficient, the first thyristor is not turned off by the reverse voltage from the capacitor which is not sufficient, with the result that the primary current is not interrupted, and ignition of the engine does not take place. Consequently, this may again limit the engine speed.

SUMMARY OF THE INVENTION

An object of the present invention is to provide an ignition system for an internal combustion engine having an AC generator rotating in synchronism with the engine and particularly an ignition system in which a current through the primary winding of an ignition coil is suddenly changed, without failure at various engine speeds, to induce a high voltage in the secondary winding.

Another object of the present invention is to provide an ignition system in which the current to be subsequently interrupted to induce a high voltage is established within a period of time which becomes shorter with increasing engine speed, so as not to set an upper limit to the engine speed.

Another object of the present invention is to provide an ignition system in which the voltage used for charging the capacitor increases as the engine speed increases, and therefore the charging is completed within a period of time which becomes shorter with increasing engine speed, so as not to limit the engine speed.

Another object of the present invention is to enhance the spark energy at the ignition plug in an ignition system by superimposing a spark due to a capacitor discharge and a spark due to interruption of the primary current.

Still another object of the invention is to simplify the construction of an ignition system.

An ignition system of the present invention comprises an ignition coil having a primary winding and a secondary winding. An ignition plug is connected across the secondary winding. In an embodiment of the present invention, the primary winding of the ignition coil is energized by a first armature winding disposed in the AC generator. In another embodiment, the ignition coil is disposed in the generator to generate electricity for itself. A first thyristor is connected across the armature winding. A capacitor is charged in a specific polarity. In an embodiment of the present invention, the capacitor is connected through rectifier means across a second armature winding disposed in the generator. In another embodiment, in which the first armature winding also acts as a second armature winding, the capacitor is connected through rectifier means aross the first armature winding. A second thyristor is so connected to apply the voltage built up on the capacitor in a reverse direction across the anode and cathode of the first thyristor. First trigger means is adapted to trigger the first thyristor at a first angle in advance of the ignition timing or angle of the engine to turn on the first thyristor to allow a short-circuit current from the armature winding to flow. Second trigger means is also adapted to trigger the second thyristor at a second angle. Conduction of the second thyristor causes turn-off of the first thyristor, and interruption of the short-circuit current through the first thyristor leads to a large current through the primary winding of the ignition coil. This large current from the armature winding induces a high voltage in the secondary winding of the ignition coil, and therefore a spark occurs in the ignition plug connected across the secondary winding.

In an embodiment of the invention, upon conduction of the second thyristor most of the discharge current is made to flow through the primary winding. The discharge current induces a high voltage in the secondary winding prior to the generation of a high voltage in the secondary winding due to the large current from the armature timing.

According to the present invention, the voltage generated in the armature winding disposed in an AC generator rotating in synchronism with the engine. The voltage increases as the speed of the engine increases. Consequently, the time required for the short-circuit current through the armature winding and the first thyristor to be fully established becomes shorter as the engine speed increases, and thereby does not limit the engine speed.

Also, the voltage used for charging the capacitor is derived from a winding disposed in the AC generator, and increases with the engine speed. Consequently, the time required for completing the charging of the capacitor becomes shorter as the engine speed increases. For this reason, the system does not limit the engine speed.

In some of the embodiments of the present invention, a discharge current from the capacitor is made to flow through the primary winding of an ignition coil to induce a high voltage in the secondary winding to provide additional spark energy prior to the high voltage generation due to the interruption of the primary current. Spark energy is thereby enhanced.

BRIEF DESCRIPTION OF THE DRAWINGS

Other features and advantages of the present invention will be apparent from the following description taken in conjunction with the accompanying drawings, in which.

DETAILED DESCRIPTION OF THE PREFERRED EMBODIMENTS

Figure 1:
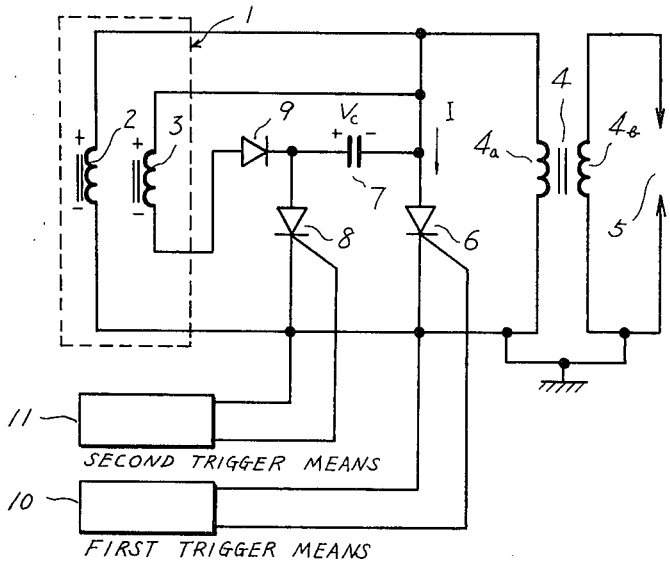
FIG. 1 shows a circuit diagram of an embodiment of an ignition system according to the present invention.

Referring now more particularly to FIG. 1, there is shown an embodiment of the ignition system according to the present invention. Designated by numeral 1 is an AC generator, such as a flywheel magneto generator, which rotates in synchronism with an internal combustion engine. Generator 1 is provided with a first armature winding 2 and a second armature winding 3. Armature windings 2 and 3 produce an AC output of the same phase in this embodiment. An ignition coil 4 has a primary winding **4*a* and a secondary winding 4*b*. Primary winding 4*a* is connected directly across the output terminals of first armature winding 2. An ignition plug 5 is connected across secondary winding 4*b*. A first thyristor 6 is connected across first armature winding 1. A capacitor 7 is connected through a second thyristor 8 across the primary winding 4*a*. More particularly, capacitor 7 is connected between the anodes of thyristors 6 and 8, and the cathodes of thyristors 6 and 8 are directly connected to each other. Capacitor 7 also has both terminals connected through a diode 9 across the output terminals of second armature winding 3. Capacitor 7 is so connected as to be charged into a polarity as indicated by marks "+" and "+" and "−" in FIG. 1 during a half cycle when second armature winding 3 produces an output of polarity opposite to that indicated in FIG. 1**.

First trigger means 10 is connected to supply a first trigger signal to the gate of first thyristor 6 at a first angle as the engine rotates. Second trigger means 11 is connected to supply a second trigger signal to the gate of second thyristor 8 at a second angle as the rotation of the engine proceeds.

Each of trigger means 10 and 11 may for instance comprise a signal generating coil mounted on a substantially I-shaped armature core or on one of radially outwardly extending portions of a salient core disposed inside an AC generator rotating in synchronism with the engine to cooperate with the magnets of the generator, and means for producing a trigger pulse at a rotational angle when the output voltage of the signal generating coil reaches a predetermined value.

Figure 2A:
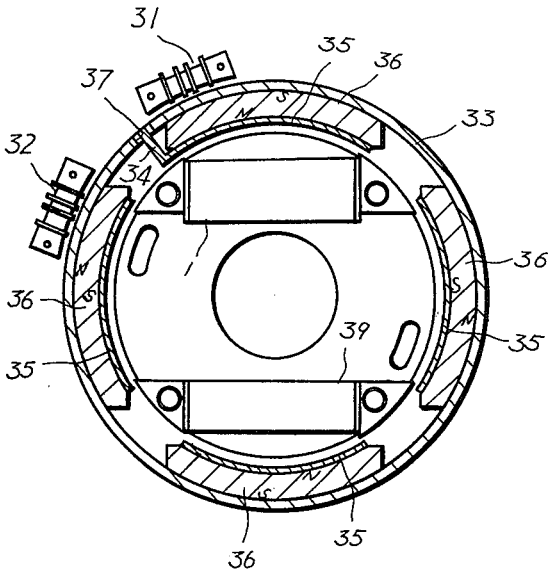
FIG. 2A is a sectional front view of a flywheel magneto generator provided with signal generators.
Figure 2B:
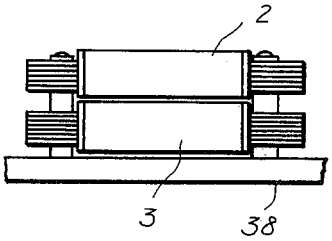
FIG. 2B is a elevational view of a first and second armatures disposed in the flywheel magneto generator of FIG. 2A, FIGS. 3A through 3I show waveforms of voltage or current at various portions of the ignition system according to the present invention.

Alternatively, where a flywheel magneto generator, such as shown in FIGS. 2A and 2B is employed, each of trigger means 10 and 11 may comprised a signal generator 31 or 32 which is positioned outside and close to the flywheel 33 of the flywheel magneto generator and produces a trigger pulse when a portion 34 extending from a pole piece 35 on one of the magnets 36 mounted inside flywheel 33 through an opening 37 provided in flywheel 33 passes signal generator 31 or 32 as flywheel 33 rotates.

In either case, trigger means 10 and 11 are so designed, or the signal generating coils are so positioned that a first trigger signal is produced nearly at the beginning of a half cycle when first armature winding 2 produces an output of a polarity as indicated in FIG. 1 and a second trigger signal is produced at an angle when the current through armature winding 2 and first thyristor 6 is nearly at its peak value.

Second trigger means may still alternatively be composed in a manner which will be described later with reference to FIG. 5.

FIG. 2A together with FIG. 2B also show, by way of example, how first and second armature windings 2 and 3 may be mounted where above mentioned flywheel magneto generator is employed. First and second armature windings 2 and 3 are respectively wounded on a substantially I-shaped cores, which are secured to a fixed plate 38. A generating winding 39 which energizes head lights and the like is also mounted, spaced from armature windings 2 and 3 by 180°.

Figure 3A:
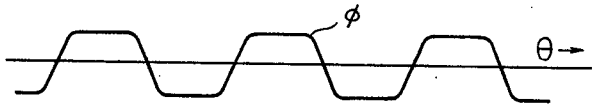
Figure 3B:
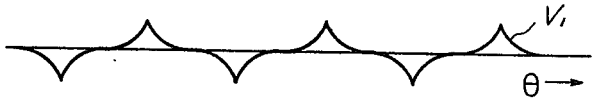
Figure 3C:
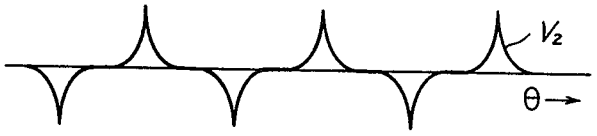
Figure 3D:
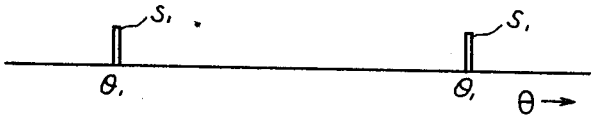
Figure 3E:
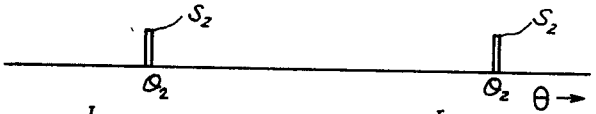
Figure 3F:
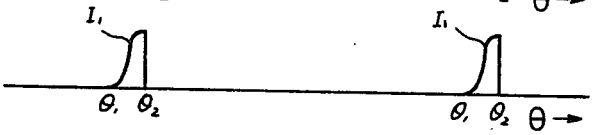
Figure 3G:
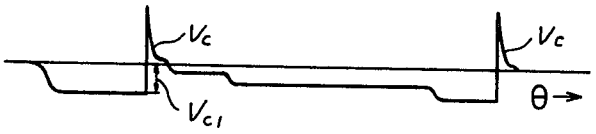
Figure 3H:
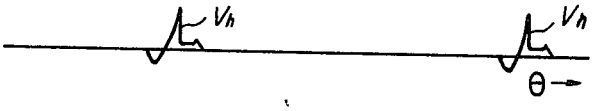
Figure 3I:
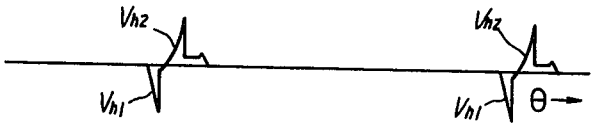

Operation of the above embodiment is now described with reference to FIGS. 3A through 3H, which show waveforms of voltage or current at various portions of the system against rotational angle $\theta$ of generator 1. FIGS. 3A, 3B and 3C respectively show variations of a magnetic flux $\phi$, a no-load voltage $V_1$ of first armature winding 2 and a no-load voltage $V_2$ of second armature winding 3. FIGS. 3D and 3E respectively show a first and second trigger signals $S_1$ and $S_2$ produced by first and second trigger means 10 and 11. FIGS. 3F and 3G respectively show the short-circuit current I through first thyristor 6 and voltage Vc across capacitor 7. FIG. 3I will be referred to later.

As already mentioned, generator 1 rotates in synchronism with the engine. During a half cycle when second armature winding 3 produces an output of a polarity opposite to that shown in FIG. 1, capacitor 7 is charged into a polarity as shown in FIG. 1 by the output of second armature winding 3 through diode 9. During the next half cycle, when first armature winding 2 produces an output of a polarity as shown in FIG. 1, first trigger means 10 supplies a first trigger signal $S_1$ to the gate of first thyristor 6 at a first angle $\theta_1$ just after the beginning of the half cycle, so that first thyristor 6 is turned on and the short-circuit current I through first armature winding 2 and first thyristor 6 begins to flow.

Thereafter, at a second angle $\theta_2$ at which the current I is approximately at its peak value, second trigger means 11 supplies a second trigger signal $S_2$ to the gate of second thyristor 8. Since second thyristor 8 is forward-biased by the voltage $Vc_1$ built up on capacitor 7, second thyristor 8 becomes conductive upon receipt of second trigger signal $S_2$. As second thyristor 8 conducts, the voltage across capacitor is applied in a reverse direction across the anode and cathode of first thyristor 6, so that first thyristor 6 is turned off. When the discharge of capacitor 7 is discharged and charged into the reverse polarity, second thyristor 8 becomes nonconductive. Inductance of first armature winding 2 tends to maintain the current through first armature winding 2. A current of the same magnitude as the short-circuit current which has been flowing through first thyristor 6 begins to flow through primary winding 4*a* of ignition coil 4, inducing a high voltage as indicated by Vh in FIG. 3H in secondary winding 4b of ignition coil 4. Consequently, ignition plug 5 is fired and ignition takes place. By setting the timing of occurrence of second trigger signal $S_2$ at the ignition angle ( precisely speaking, a little before it allowing for the time required for the discharge of capacitor 7), ignition of the engine is appropriately timed.

According to the embodiment described above, a short-circuit current supplied from first armature winding 2 disposed in AC generator 1 rotating in synchronism with the engine is utilized, and the current is established within a period of time which becomes shorter with increasing engine speed. Accordingly, the engine speed is not limited by such time required for establishing the primary current. Also, capacitor 7 is charged by an output from second armature winding 3 disposed in AC generator 1 within a period of time which becomes shorter with increasing engine speed, so that the engine speed is not limited by such time required for charging capacitor 7.

Figure 4:
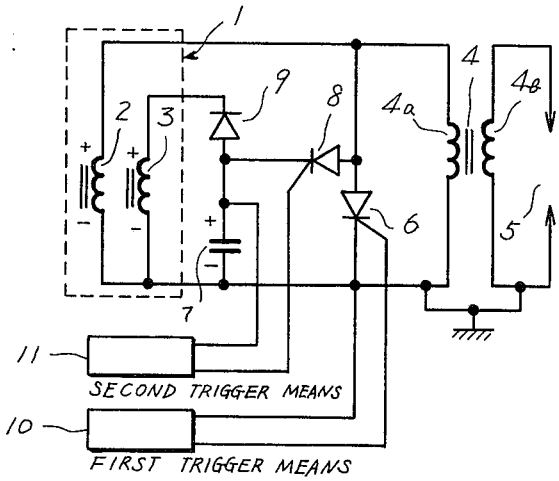
FIGS. 4 through 8 show circuit diagrams of other embodiments of the present invention.

FIG. 4 shows another embodiment of an ignition system according to the present invention. In this embodiment, the anode of second thyristor 8 is connected to an end of primary winding 4*a*, and capacitor 7 is connected between the cathode of second thyristor 8 and the other end of primary winding 4*a*. In other words, positions of capacitor 7 and second thyristor 8 are reversed. The rest of the connections and the operation of this embodiment are substantially identical to those described about the embodiment of FIG. 1.

Figure 5:
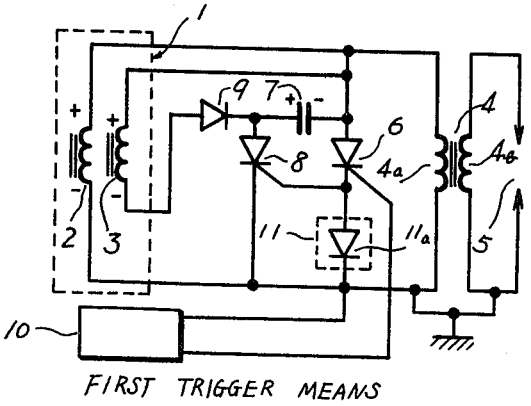

FIG. 5 shows another embodiment of the present invention. In this embodiment impedance means which is shown as a diode 11*a*, is connected in series with first thyristor 6, and voltage across the impedance means is applied across the gate and cathode of second thyristor 8. The impedance means thus constitutes second trigger means 11. The rest of the connections and operation of the system are substantially identical to those of the embodiment of FIG. 1.

Figure 6:
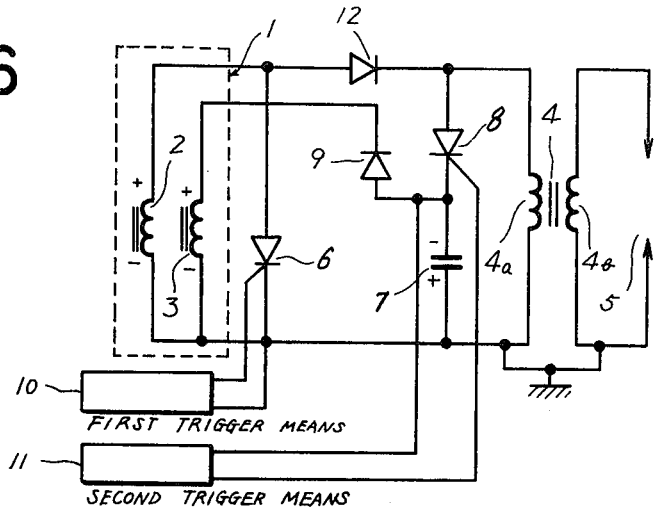

FIG. 6 shows still another embodiment of the present invention. In this embodiment, a diode 12 is inserted between first armature winding 2 and primary winding 4*a*. The rest of the connections of this embodiment are substantially identical to those in FIG. 4.

Diode 12 acts as additional impedance in series with first armature winding 2, so that more discharge current from capacitor 7 flows through primary winding 4*a* than if diode 12 is not employed as in FIG. 4. Because of this discharge current through primary winding 4*a*, a high voltage as indicated by $Vh_1$ in FIG. 3I is generated in secondary winding 4*b*, prior to generation of a high voltage as indicated by $Vh_2$ in FIG. 3I due to subsequent large current supplied from the first armature winding 2. Accordingly, plug 5 is fired twice in one operation of ignition. The total spark energy is larger than where only a spark due to the current from first armature winding 2 is utilized. As is known in the art, enhancement of the spark energy is one of the desiderata in view of prevention of environmental polution.

Figure 7:
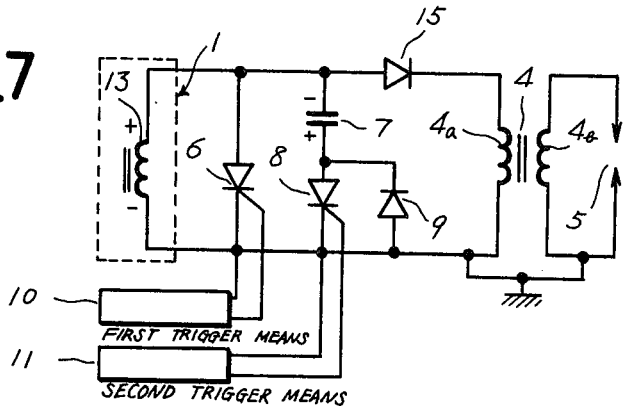

The various embodiments described hereinbefore employ a first armature winding for supplying an electric current to ignition coil 4 and a separate second armature winding 3 for charging capacitor 7. But it is possible tc have a single armature winding with dual function, in an attempt to simplify the construction of the system. FIG. 7 shows an embodiment in which an armature winding 13 disposed in generator 1 is used to supply a current to ignition coil 4 as well as to charge capacitor 7 through diode 9. A diode 15 is inserted in series with primary winding 4a to prevent a current in reverse direction thereby permitting capacitor 7 to be fully charged in the polarity as indicated in FIG. 7. The rest of the connections and the operation of this embodiment are substantially identical to those of the embodiment of FIG. 1.

Figure 8:
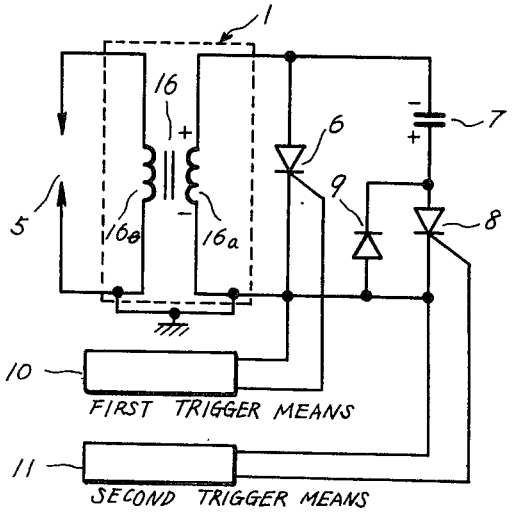

The embodiments described hereinbefore include an ignition coil and a separate first armature winding. However, it is also possible to dispose the primary winding of an ignition coil in an AC generator and have it generate electricity for itself as, for example, is shown in FIG. 8. In this embodiment, an ignition system comprises an ignition coil 16 having a primary winding 16a and a secondary winding 16*b*. Primary winding 16*a* is disposed in generator 1. Secondary winding 16*b* is magnetically coupled to primary winding 16a. First thyristor 6 is connected to the ends of primary winding 16a of ignition coil 16. The rest of connections are substantially identical to those in FIG. 7.

When first thyristor conducts a short-circuit current flows through thyristor 6. When second thyristor 8 conducts the voltage across capacitor 7 which has been charged by primary winding 16a is applied in a reverse direction across first thyristor 6, and first thyristor 6 is turned off. When capacitor 7 is discharged and charged into the reverse polarity, the current through primary wnding 16*a* is interrupted, and therefore a high voltage is generated in secondary winding 16*b*.

It is noted that in all the embodiments hereinbefore described, positions of capacitor 7 and second thyristor 8 can be reversed as exemplified in FIG. 4 as against FIG. 1. In all the embodiments, the second trigger means may consists of impedance means such as a diode connected in series with first thyristor 6 as shown in FIG. 5.

While there have been described what are at present considered to be thepreferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is;

1. An ignition system for an internal combustion engine having an AC generator rotating in synchronism with the engine, said ignition system comprising;

an ignition coil having a primary winding and a secondary winding, a first armature winding disposed in the generator to supply a current to said primary winding of said ignition coil, a first thyristor connected in parallel with said first armature winding, a second armature winding disposed in the generator, a capacitor connected through rectifier means across said second armature winding, a second thyristor for applying the voltage built up on said capacitor reversely across the anode and cathode of said first thyristor, first trigger means for triggering said first thyristor at a first angle, and second trigger means for triggering said second thyristor at a second angle, whereby conduction of said second thyristor causes turn-off of said first thyristor and resultant interruption of the current through said first thyristor leads to a large current through said primary winding of said ignition coil.

2. An ignition system as set forth in claim 1, wherein said primary winding of said ignition coil is connected directly across said first armature winding and said capacitor is connected through said second thyristor across the anode and cathode of said first thyristor.

3. An ignition system as set forth in claim 1, wherein said primary winding of said ignition coil is connected through a diode across first armature winding, said first thyristor is connected across said first armature winding and said capacitor is connected through said second thyristor across said primary winding of said ignition coil.

4. An ignition system for an internal combustion engine having an AC generator rotating in synchronism with the engine, said ignition system comprising;

an ignition coil having a primary winding and a secondary winding, an armature winding disposed in the generator to supply a current to said primary winding of said ignition coil, a first thyristor connected in parallel with said armature winding, a capacitor connected through rectifier means across said armature winding, a second thyristor for applying the voltage built up on said capacitor reversely across the anode and cathode of said first thyristor, first trigger means for triggering said first thyristor at a first angle, and a second trigger means for triggering said second thyristor at a second angle, whereby conduction of said second thyristor causes turn-off of said first thyristor and resultant interruption of the current through said first thyristor leads to a large current through said primary winding of said ignition coil.

* * * * *